US006781545B2

(12) United States Patent
Sung

(10) Patent No.: US 6,781,545 B2
(45) Date of Patent: Aug. 24, 2004

(54) BROADBAND CHIP ANTENNA

(75) Inventor: Jae Suk Sung, Suwon (KR)

(73) Assignee: Samsung Electro-Mechanics Co., Ltd. (KR)

( * ) Notice: Subject to any disclaimer, the term of this patent is extended or adjusted under 35 U.S.C. 154(b) by 12 days.

(21) Appl. No.: 10/230,981

(22) Filed: Aug. 30, 2002

(65) Prior Publication Data

US 2003/0222827 A1 Dec. 4, 2003

(30) Foreign Application Priority Data

May 31, 2002 (KR) ..... 2002-30712

(51) Int. Cl.[7] ..... H01Q 1/38
(52) U.S. Cl. ..... 343/700 MS; 343/702
(58) Field of Search ..... 343/700 MS, 702, 343/846, 848, 767, 770

(56) References Cited

U.S. PATENT DOCUMENTS 5,760,746 A * 6/1998 Kawahata ..... 343/702
5,861,854 A * 1/1999 Kawahata et al. ..... 343/702
6,323,811 B1 * 11/2001 Tsubaki et al. ..... 343/700 MS
6,448,932 B1 * 9/2002 Stoiljkovic et al. .. 343/700 MS
6,614,398 B2 * 9/2003 Kushihi et al. ..... 343/700 MS

* cited by examiner

*Primary Examiner*—Tan Ho
(74) *Attorney, Agent, or Firm*—Lowe Hauptman Gilman & Berner LLP

(57) ABSTRACT

Disclosed is a chip antenna including first and second electrode patterns serving as radiation elements as well as a power-feeding element and a ground element, respectively. The first and second electrode patterns are separated from each other by first and second slits. The dimension of the electrode patterns is increased by extending the width of the first electrode pattern to correspond to the length of the first slit, and the first and second electrode patterns form the successive resonant length via the second slit. The chip antenna of the present invention has a broad usable frequency band. This broadband chip antenna of the present invention may be achieved as a super broadband chip antenna with multi-band characteristics. The frequency characteristics of the chip antenna may be easily adjusted by varying the width of the slit and the length of the electrode pattern or by forming a supplementary slit or an open area.

17 Claims, 10 Drawing Sheets

BROADBAND CHIP ANTENNA

BACKGROUND OF THE INVENTION

1. Field of the Invention

The present invention relates to a broadband chip antenna, and more particularly to a super broadband chip antenna with first and second electrode patterns serving as radiation elements as well as a power-feeding element and a ground element, respectively.

2. Description of the Related Art

Recently, development trends of mobile communication terminals have been directed toward miniaturization and light weight. In order to satisfy these trends, internal circuits and components of the mobile communication terminal have been developed to be miniaturized. Therefore, an antenna of the mobile communication terminal has also been miniaturized. A planar inverted F-type antenna (referred to as a "PIFA") is suitable for the miniaturization of the antenna of the mobile communication terminal, thus widely being used.

FIG. 1 shows a conventional chip antenna, i.e., a PIFA 10. With reference to FIG. 1, the PIFA 10 comprises a radiation patch 12 as a planar rectangular form, and a dielectric block 11. The dielectric block 11 includes a short-circuit pin 14 and a power-feeding pin 16. The short-circuit pin 14 and the power-feeding pin 16 are connected to the radiation patch 12. This configuration of the PIFA 10 is designed so that the radiation patch 12 is fed with a power via an electrical connection between the power-feeding pin 16 and the radiation patch 12 or an EM (Electro-Magnetic) feeding system, and a part of the radiation patch 12 is electrically connected to a ground portion (not shown), thereby being suitable for a resonant frequency or an impedance matching of the antenna 10. The PIFA 10 shown in FIG. 1 is operated by a system in which the current is induced on the radiation patch 12 with an electrical length to resonate at a designated frequency band range via the power-feeding pin 16.

However, this configuration of the PIFA has a problem of having a narrow frequency bandwidth.

FIG. 2 is a graph showing VSWR (Voltage Standing Wave Ratio) of the PIFA of FIG. 1. The narrow band characteristics of the PIFA of FIG. 1 are described with reference to the graph showing VSWR (Voltage Standing Wave Ratio) of the chip antenna for BT (Blue Tooth) band as shown in FIG. 2. As shown in FIG. 2, the PIFA for BT band has a bandwidth of approximately 180 MHz at frequency band of 2.34–2.52 GHZ with the VSWR of less than 2:1. This bandwidth seems to satisfy the BT band (approximately 2.4–2.48 GHZ), but actually it does not. That is, the actual frequency band of the antenna is changed by the form of the mobile communication terminal set employing the antenna. More particularly, the actual frequency band of the antenna is shifted by environmental influence acting on the mobile communication terminal such as a contact with a human body. As a result, it is difficult to have a usable frequency band satisfying a desired frequency band. The aforementioned narrow frequency band problem is an important drawback of a miniaturized chip antenna.

In order to solve the problem, in designing the chip antenna, the shifting of the resonant frequency and the impedance must be considered, thereby lengthening the development period and increasing the production cost of the chip antenna.

Further, in order to solve the narrowband characteristics, a distribution circuit such as a chip type LC device may be additionally connected to the antenna, thereby adjusting the impedance matching and obtaining a comparatively broad frequency band. However, this method of using an external circuit in adjusting the frequency of the antenna may cause another problem of deteriorating antenna efficiency. Alternatively, in order to obtain the broadband characteristics, the size of the antenna may be increased. However, since the increase of the size of the antenna does not satisfy the miniaturization trend, this method is not preferred.

Accordingly, a new PIFA structure, which satisfies the miniaturization trend, is usable at various frequency bands, and improves the narrow band characteristics, has been demanded.

SUMMARY OF THE INVENTION

Therefore, the present invention has been made in view of the above problems, and it is an object of the present invention to provide a chip antenna comprising an electrode pattern formed on entire surfaces of a first surface, a second surface, and two opposite side surfaces disposed between the first and second surfaces of a dielectric block, and slits individually formed on the first and second surfaces, thereby dividing the electrode pattern into a first electrode pattern including a feeding port area and a second electrode pattern including a ground port area.

In accordance with one aspect of the present invention, the above and other objects can be accomplished by the provision of a chip antenna comprising: a dielectric block including a first surface, a second surface being opposite to the first surface, and side surfaces being disposed between the first and second surfaces; a first electrode pattern extending from a feeding port area formed on the first surface to the second surface via the adjacent side surface; and a second electrode pattern extending from a ground port area formed on the first surface to the second surface via the adjacent side surface, wherein a first slit is formed as an open area for connecting two opposite sides of the first surface so as to electrically separate the feeding port area of the first electrode pattern from the ground port area of the second electrode pattern, and a second slit is formed in the same direction as the first slit as another open area for connecting two opposite sides of the second surface so as to form an electromagnetic coupling between the first and second electrode patterns.

Preferably, the first and/or second electrode pattern(s) may extend so that a length of its one side adjacent to the first slit is substantially the same as a length of its the other side adjacent to the second slit.

Further, preferably, various tuning factors may be applied to adjust resonant frequency characteristics of the chip antenna. The resonant frequency characteristics of the chip antenna may be adjusted by varying an extending length L1 of the first electrode pattern and/or an extending length L2 of the second electrode pattern. Further, the resonant frequency characteristics of the chip antenna may be adjusted by varying a width of the second slit.

Yet, preferably, the chip antenna of the present invention may further comprise at least one supplementary slit formed on the first or second electrode pattern in order to separate the first or second electrode pattern into two electrode pattern areas. In this case, the resonant frequency characteristics of the chip antenna may be adjusted by varying a position and a form of the supplementary slit.

Still, preferably, at least one open area may be formed on the first or second surface. The resonant frequency characteristics of the chip antenna may be adjusted by forming the open area.

The first and second slits may be formed on the first and second surfaces so that the first electrode pattern extends from the feeding port area of the first surface to the second surface, and the second electrode pattern extends from the ground port area of the first surface to the second surface. Thus, the first and second electrode patterns may serve as radiation elements as well as a power-feeding element and a ground element, respectively. Since the power feeding and the radiation are successively achieved via the first and second slits, the chip antenna of the present invention has a much broader bandwidth.

In accordance with another aspect of the present invention, there is provided a chip antenna comprising: a dielectric block including a upper surface, a lower surface, and side surfaces being disposed between the upper and lower surfaces; an electrode formed on the entire surfaces of the upper and lower surface, and two opposite side surfaces; and slits for connecting opposite sides of two side surfaces without the electrode and dividing the electrode to a first electrode pattern and a second electrode pattern, each of the slits being formed on the upper and lower surfaces of the dielectric block, wherein the slit formed on the lower surface of the dielectric block at least separates a feeding port area from a ground port area, and the other slit formed on the upper surface of the dielectric block connects the first electrode pattern to the second electrode patterns by an EM(Electro-Magnetic) coupling.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, preferred embodiments of the present invention will be described in detail with reference to the annexed drawings.

Figure 3:
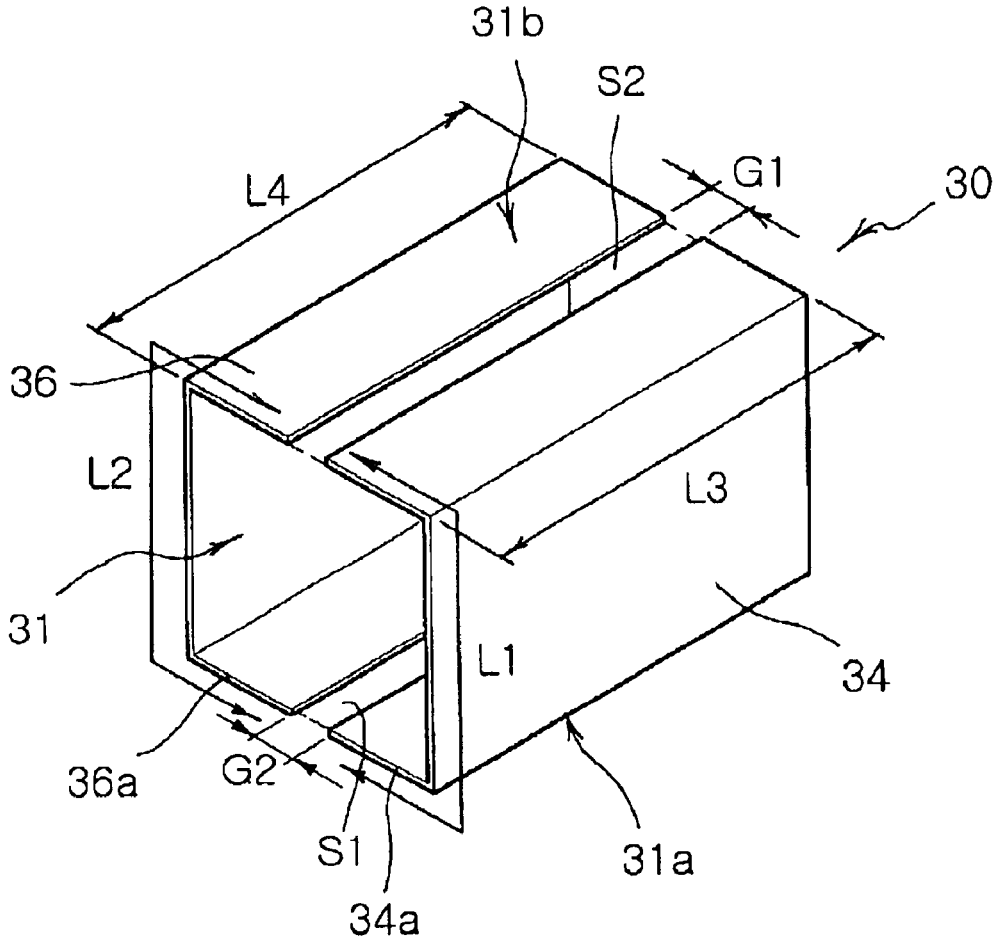
FIG. 3 is a schematic perspective view of a chip antenna in accordance with an embodiment of the present invention.

FIG. 3 is a schematic perspective view of a chip antenna 30 in accordance with an embodiment of the present invention. With reference to FIG. 3, the chip antenna 30 comprises a dielectric block 31 including a first surface 31*a* and a second surface 31*b*. An electrode is formed on most surfaces of the dielectric block 31 including the first and second surfaces 31*a* and 31*b* and two opposite side surfaces disposed between the first and second surfaces 31*a* and 31*b*. The electrode patterns are divided into a first electrode pattern 34 and a second electrode pattern 36 by a first slit S1 for connecting two opposite sides of the first surface 31*a* and a second slit S2 for connecting two opposite sides of the second surface 31*b*. The first electrode pattern 34 includes a feeding port area 34*a* formed on the first surface 31*a*, and the second electrode pattern 36 includes a ground port area 36*a* formed on the first surface 31*a*.

Herein, the term 'slit' refers to an open area in the form of a line with its both ends open, and differs from the term 'slot' which refers to an open area with its one end open or with its both ends closed within a conductive pattern.

As shown in FIG. 3, the first electrode pattern 34 is formed so that a length of one side of the first electrode pattern 34 formed along the first slit S1 on the first surface 31*a* is the same as a length of another side of the first electrode pattern 34 formed along the second slit S2 on the second surface 31*b*, thereby increasing the size of the first electrode pattern 34. Herein, the length of the side of the first electrode pattern 34 is a width L3 of the first electrode pattern 34.

Further, the chip antenna 30 of FIG. 3 may be constructed by forming an electrode entirely on the first and second surfaces 31*a* and 31*b* of the dielectric block 31 and the two opposite side surfaces disposed between the first and second surfaces 31*a* and 31*b* of the dielectric block 31, and then by forming two slits, i.e., the first and second slits S1 and S2. As described above, in the chip antenna of the present invention having a different structure from the conventional PIFA, the feeding port area 34*a* of the first electrode pattern 34 is connected to an external circuit to be fed with power, and the second electrode pattern 36 separated from the first electrode pattern 34 by the first and second slits S1 and S2 is connected to an external ground portion (not shown) via the ground port area 36*a* on the first surface 31*a*. Herein, the first electrode pattern 34 serves as a power-feeding element of the antenna and partly as a radiation element of the antenna due to the large size of the electrode pattern 34 itself. The second pattern 36 connected to the first electrode pattern 34 by the EM coupling via the second slit S2 serves partly as a radiation element.

Therefore, since the power-feeding and the radiation are successively achieved via the first and second slits S1 and S2 disposed between the first and second electrode patterns 34 and 36, the chip antenna of the present invention has a much broader bandwidth than that of the conventional chip antenna with the same dimension. More specifically, the lowermost resonant frequency is determined by the length of the first and second electrode patterns 34 and 36, and gradually higher frequencies successively resonate along the second slit S2. Therefore, the chip antenna of the present invention has a broad usable frequency bandwidth.

Figure 1:
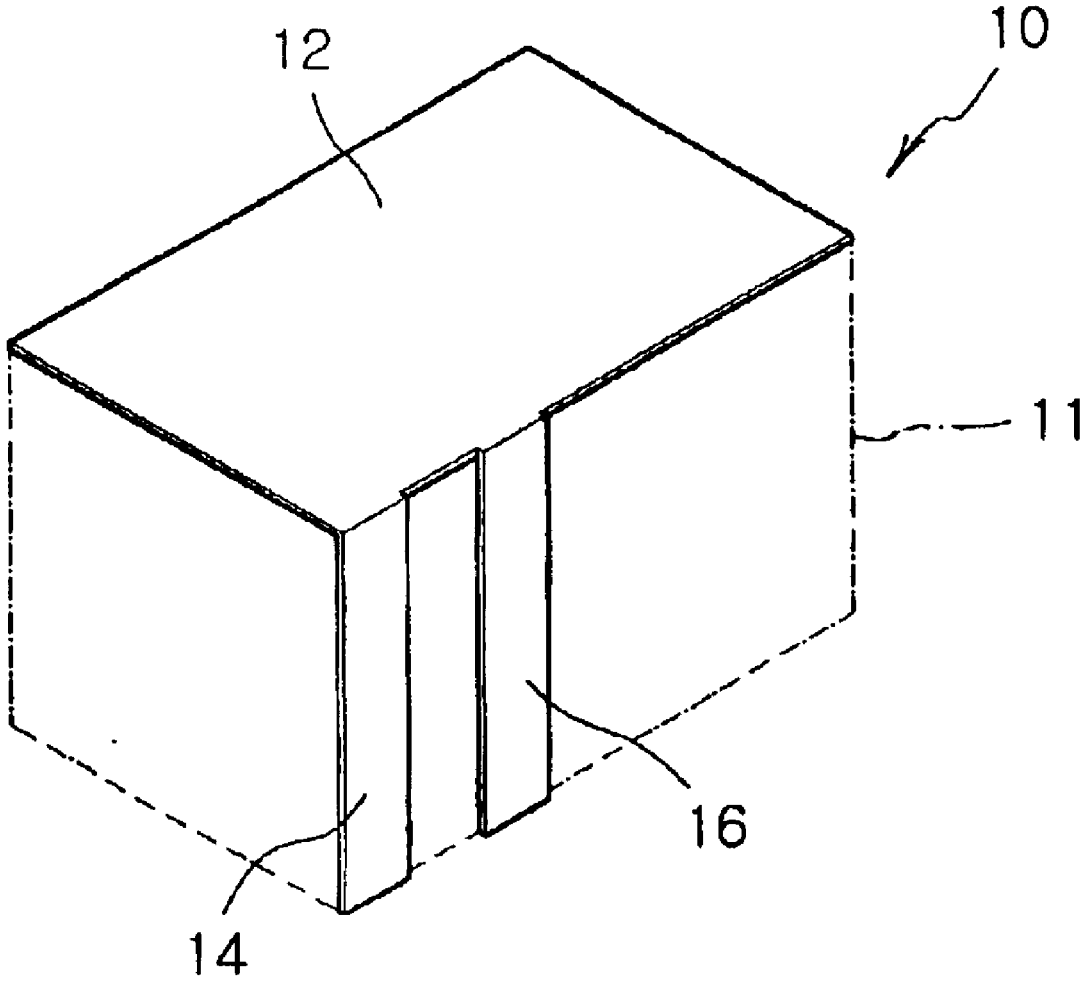
PRIOR ART FIG. 1
FIG. 1 is a schematic perspective view of a conventional chip antenna, i.e., a planar inverted F-type antenna (PIFA)
Figure 2:
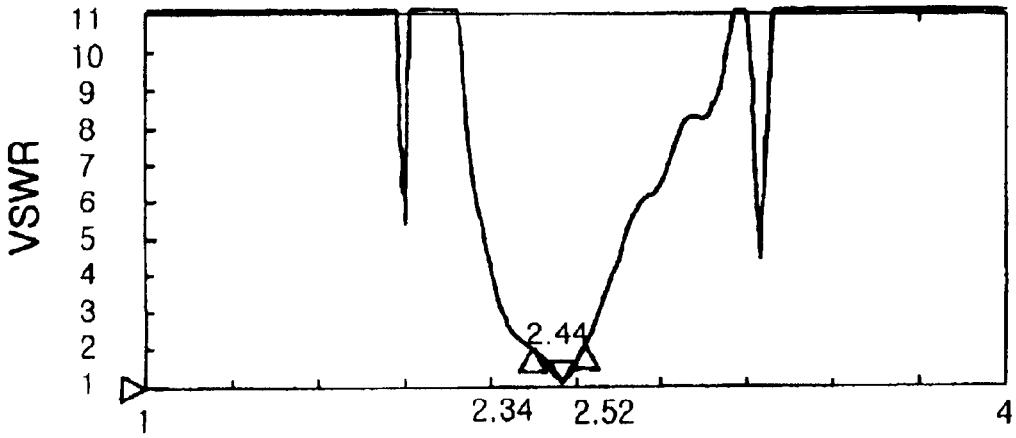
PRIOR ART FIG. 2
FIG. 2 is a graph showing VSWR (Voltage Standing Wave Ratio) of the chip antenna of FIG. 1.
Figure 4:
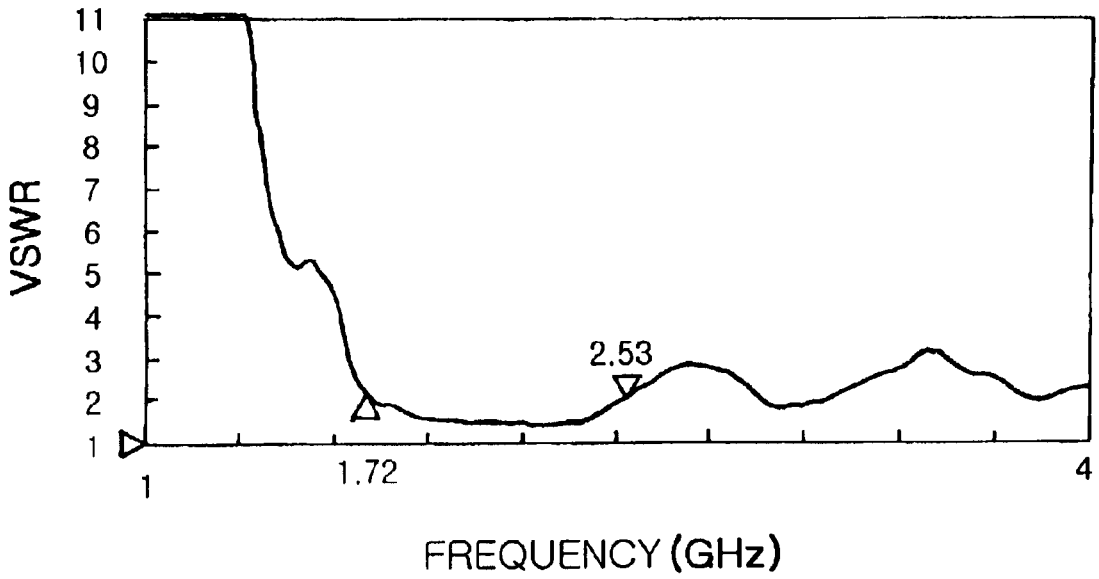
FIG. 4 is a graph showing VSWR (Voltage Standing Wave Ratio) of the chip antenna of FIG. 3.

FIG. 4 is a graph showing VSWR (Voltage Standing Wave Ratio) of the chip antenna 30 with the same dimension (15×7×6 mm) as that of the antenna of FIG. 2. The chip antenna 30 has a successive electrical length that can resonate at a broad frequency band determined by the total length of the electrodes surrounding the dielectric block through the first and second surfaces and the side surfaces, and by the structure of the slits for separating the first and second electrode patterns from each other. An improved bandwidth result is shown in FIG. 4. In the same manner as FIG. 2, when the usable frequency band is designated to have the VSWR of less than 2.0:1, the chip antenna of the present invention has a bandwidth of 180 MHz at a frequency band range of approximately 1.72–2.53 GHZ, thereby having broadband characteristics. Therefore, compared to the conventional chip antenna of FIG. 2, the chip antenna of the present invention can have a five times more bandwidth without increasing the size of the chip antenna.

Further, as shown in FIG. 4, the chip antenna of the present invention is usable at super broadband including a K-PCS band (approximately 1.75–1.87 GHz), a US-PCS band (approximately 1.85–1.99 GHz), a BT band (approximately 2.4–2.48 GHz), etc. required by the antennas of recent mobile communication terminals. Further, these super broadband characteristics of the chip antenna of the present invention can be used as multi-band characteristics. Therefore, the chip antenna of the present invention has another advantage of obtaining multi-band characteristics without using a complex method of forming a U-type slot on a radiation patch.

Figure 5A:
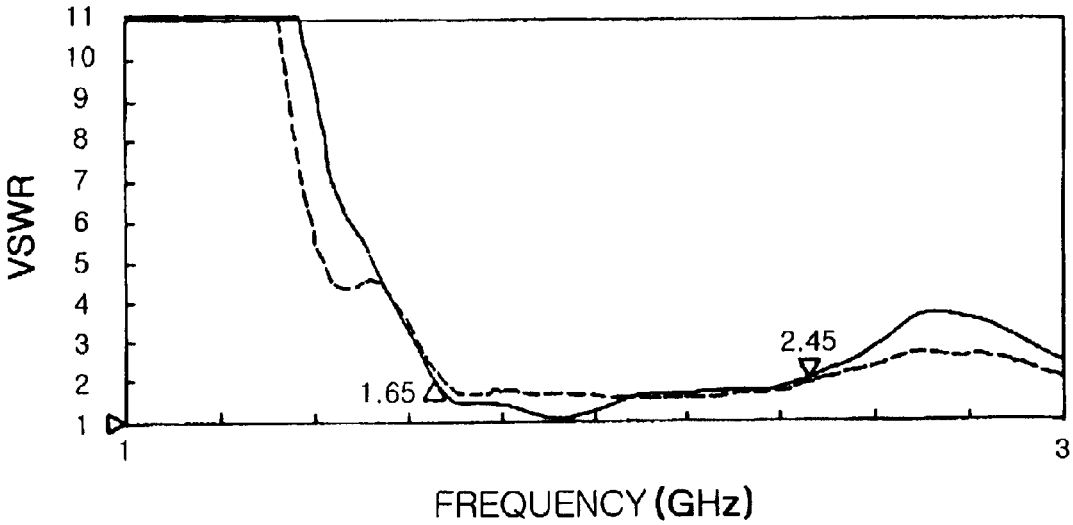
FIGS. 5*a* to 5*c* are graphs showing VSWR (Voltage Standing Wave Ratio) in order to describe tuning factors of the chip antenna of the present invention.
Figure 5A:
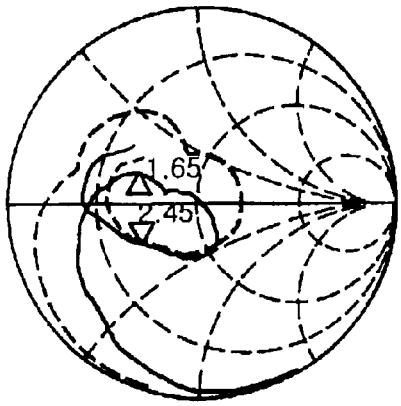
Figure 5B:
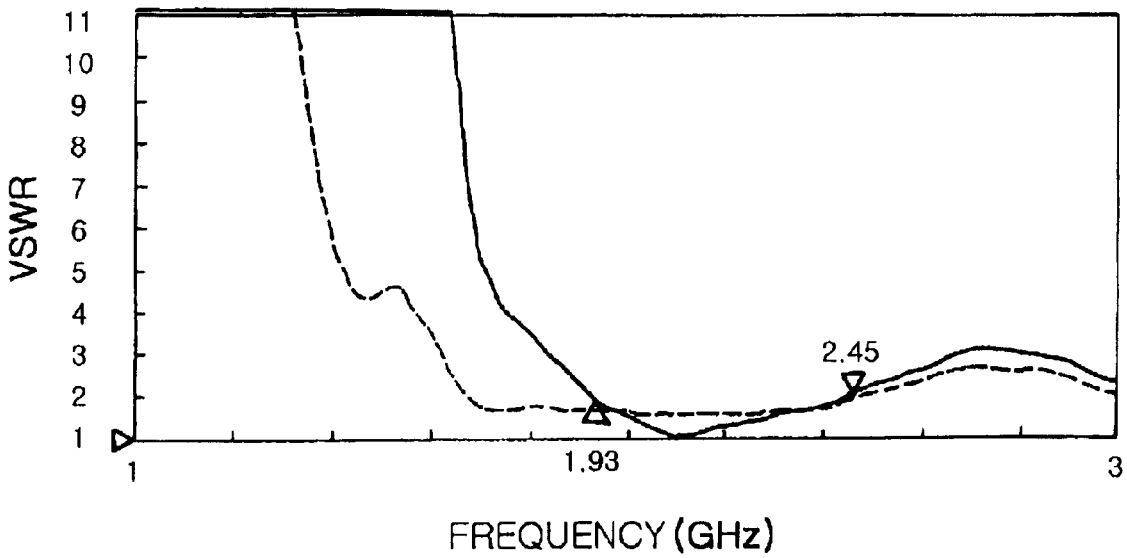
Figure 5B:
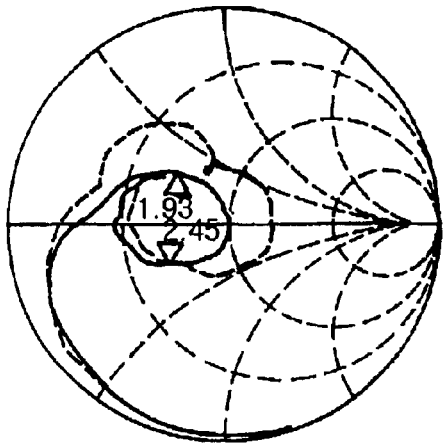
Figure 5C:
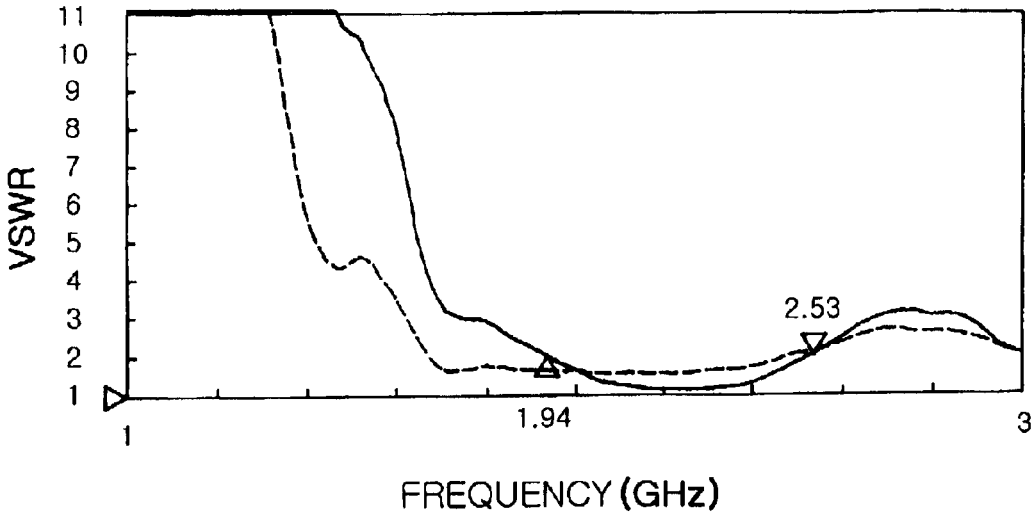
Figure 5C:
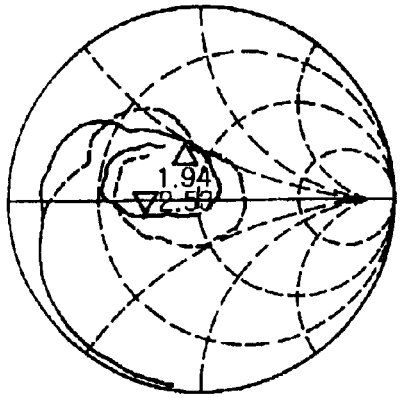

Moreover, the resonant frequency and the bandwidth of the chip antenna of the present invention are adjusted by varying the length, the width, and the height of the electrode pattern and the position and the width of the first and second slits. FIGS. 5*a* to 5*c* are graphs showing the change of the VSWR (Voltage Standing Wave Ratio) by varying the width of the individual slits and the length of the electrode pattern.

Hereinafter, with reference to FIG. 3 and FIGS. 5*a* to 5*b*, the change of the resonant frequency and the bandwidth of the chip antenna of the present invention by varying the width of the slit and the length of the electrode pattern is described in detail.

In case the width G2 of the second slit of the chip antenna of FIG. 3 increases and the length L1 of the first electrode pattern of the chip antenna of FIG. 3 decreases, a frequency band is at a range of approximately 1.65–2.45 GHz, as shown in FIG. 5*a*. Compared to VSWR characteristics of the chip antenna of FIG. 3 represented as a dotted line, the frequency band of this case moves by approximately 100 MHz toward a lower frequency band and a size of an impedance circle is reduced.

Further, in case the width G2 of the second slit increases and the length L2 of the second electrode pattern decreases, a frequency band is at a range of approximately 1.93–2.45 GHz and VSWR is a little high around the center frequency as shown in FIG. 5*b*. Further, a size of an impedance circle is also reduced. Compared to the chip antenna of FIG. 3, the frequency band of this case is somewhat narrow but still broad (approximately 520 MHz).

Moreover, in case the width L4 of the second electrode pattern decreases, a frequency band is at a range of approximately 1.94–2.53 GHz and VSWR is a little high around the center frequency as shown in FIG. 5*c*. Also, a size of an impedance circle is reduced.

As described above, the frequency characteristics of the chip antenna may be easily adjusted by varying the lengths L1 and L2 of the first and second electrode patterns together with the width G1 of the first slit or by varying the width L4 of the second electrode pattern.

In accordance with another embodiment of the present invention, the antenna characteristics of the chip antenna can be changed by additionally forming at least one supplementary slit on the first electrode pattern or the second electrode pattern. The frequency characteristics may be changed by varying the position and the form of the supplementary slit.

For example, the supplementary slit may be configured such that one end of the supplementary slit is opened to the first slit and the other end of the supplementary slit is opened along the side surface on which the second electrode pattern is formed. On the contrary, the supplementary slit may be configured such that one end of the supplementary slit is opened to the second slit and the other end of the supplementary slit is opened along the side surface on which the first or second electrode pattern is formed. Further, the supplementary slit may be configured such that two ends of the supplementary slit are opened to two opposite sides in the same direction of the first slit on the first or second electrode pattern. That is, the first or second electrode pattern may be divided into an electrode pattern area including the ground port area and another electrode pattern area connected to the second slit by the supplementary slit. This supplementary slit is easily formed on the side surface of the first or second electrode pattern, that is, the side surfaces corresponding to the electrode patterns among side surfaces of the dielectric block.

Figure 6:
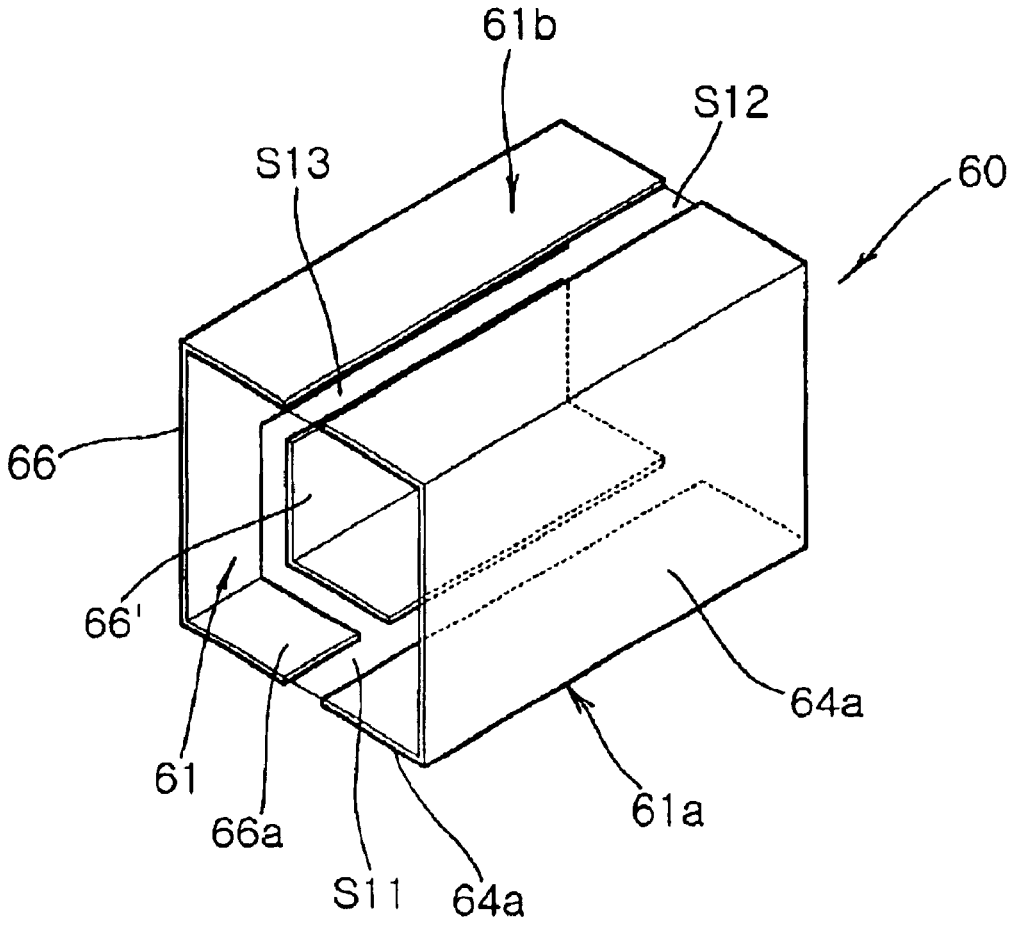
FIG. 6 is a schematic perspective view of a chip antenna in accordance with another embodiment of the present invention.

FIG. 6 shows a chip antenna provided with the supplementary slit in accordance with another embodiment of the present invention.

With reference to FIG. 6, similarly to the chip antenna 30 of FIG. 3, the chip antenna 60 comprises a first slit S11 formed on a first surface 61*a* and a second slit S12 formed on a second surface 61*b* of a dielectric block 61. An electrode is formed on most surfaces of the dielectric block 61 including the first and second surfaces 61*a* and 61*b* and two opposite side surfaces disposed between the first and second surfaces 61*a* and 61*b*. The electrode patterns are divided into a first electrode pattern 64 and a second electrode pattern 66 by the first and second slits S11 and S12. The same as the first electrode pattern 34 of FIG. 3, the first electrode pattern 64 of the chip antenna 60 includes a large piece extending from a feeding port area 64*a* on the first surface 61*a* to the second slit S12 of the second surface 61*b* via the adjacent side surface. The second electrode pattern 66 includes a piece extending from a ground port area 66*a* of the first surface 61*a* to the second slit S12 of the second surface 61*b* via the adjacent side surface. Further, The second electrode pattern 66 is separated from a third electrode pattern 66' by a supplementary third slit S13. Herein, the third slit S13 is configured such that one end of the third slit S13 is connected to the first slit S11 and the other end of the third slit S13 is opened to one side surface. This configuration of the third slit S13 may be variously modified by the antenna characteristics, and another slit may be further provided.

Figure 7:
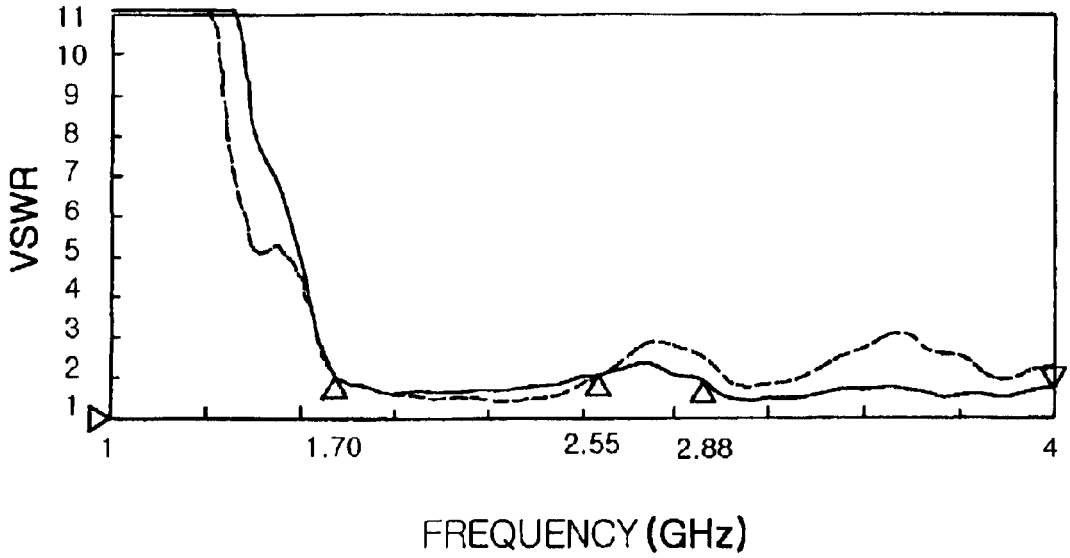
FIG. 7 is a graph showing VSWR (Voltage Standing Wave Ratio) of the chip antenna of FIG. 6.

FIG. 7 is a graph showing VSWR (Voltage Standing Wave Ratio) of the chip antenna 60 of FIG. 6. With reference to FIG. 6, VSWR of less than 2.0:1 is at two bands, i.e., a band of approximately 1.7–2.55 GHz and at a band of approximately 2.88–4.0 GHz. Since VSWR at a band of 2.55–2.88 GHz between the aforementioned two bands is less than 2.5:1, the 2.55–2.88 GHz is substantially a usable frequency band. Therefore, the chip antenna of this embodiment of the present invention may be used as a super broadband chip antenna with a bandwidth of approximately 2,300 MHz, which can resonate at a band range of approximately 1.7–4.0 GHz.

In the chip antenna of the present invention, the antenna characteristics such as the resonant frequency and the impedance may be adjusted by forming an open area on the first and/or second electrode patterns of the first embodiment, or on the first, second, and/or third electrode patterns of the second embodiment.

The configuration of the open area may be variously selected by the required frequency characteristics. For example, the open area may be configured such that one end of the open area is disposed within the first or second electrode pattern and the other end of the open area is opened to other side surface adjacent to the first or second electrode pattern. The open area may be configured such that the entire open area including two ends is disposed within the first or second electrode pattern.

The position of the open area may be variously selected. That is, the open area may be formed on the first or second surface. Herein, the open area may be extended to the side surface adjacent to the first or second surface, or the open area may be formed only on the side surface.

Figure 8:
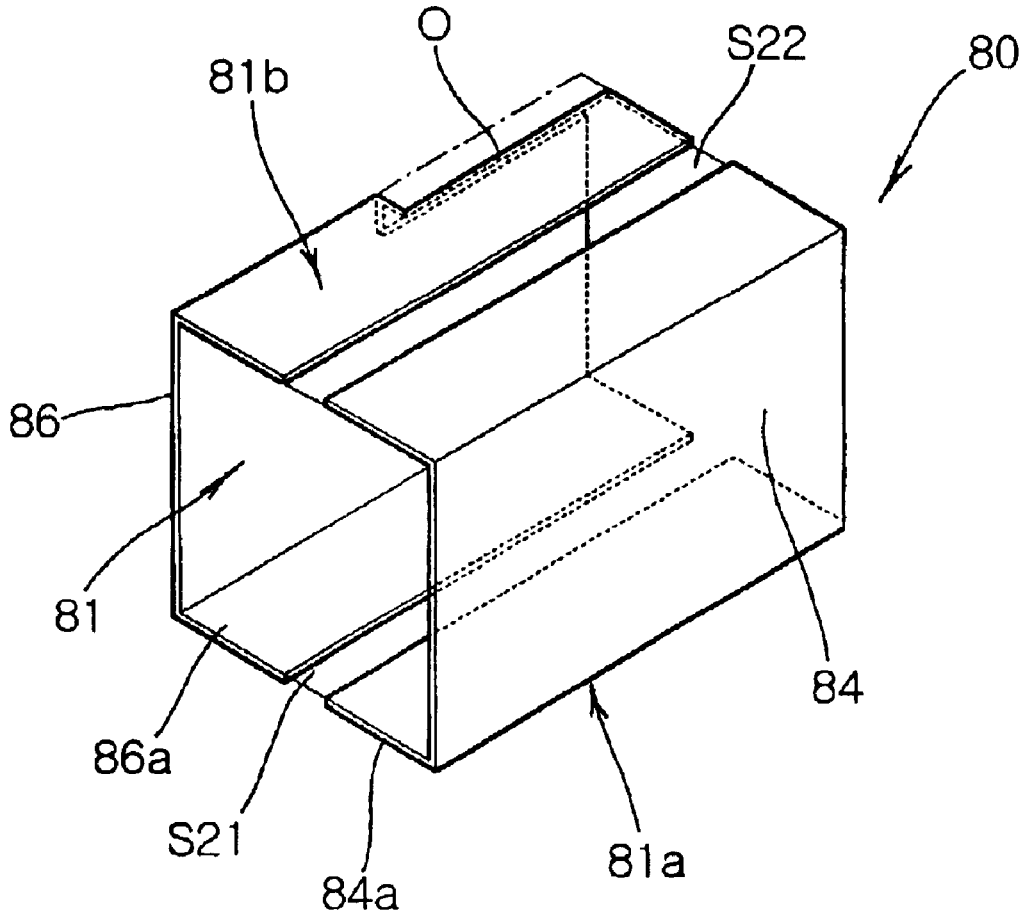
FIG. 8 is a schematic perspective view of a chip antenna in accordance with yet another embodiment of the present invention.

FIG. 8 shows a chip antenna 80 provided with an open area O formed on a second electrode pattern 86 in accordance with yet another embodiment of the present invention. The chip antenna 80 comprises a dielectric block 81 including a first surface 81*a* and a second surface 81*b*, and a first slit S21 formed on the first surface 81*a* and a second slit S22 formed on the second surface 81*b*. An electrode is formed on most surfaces of the dielectric block 81 including the first and second surfaces 81*a* and 81*b* and two opposite side surfaces disposed between the first and second surfaces 81*a* and 81*b*. The electrode patterns are divided into a first electrode pattern 84 and a second electrode pattern 86 by the first and second slits S11 and S12. The first electrode pattern 84 includes a feeding port area 84*a* on the first surface 81*a*, and the second electrode pattern 86 includes a ground port area 86*a* on the first surface 81*a*. Further, the second electrode pattern 86 includes the open area O extending from a designated area of the second surface 81*b* to the side surface being adjacent to the second surface 81*b*. As described above, the open area O is formed as a slot type differing from the slit. One end of the open area O is disposed within the second electrode pattern 86 and the other end of the open area O is opened.

As described above, the chip antenna of the present invention is constructed by forming an electrode pattern entirely on the first and second surfaces of the dielectric block and the two opposite side surfaces disposed between the first and second surfaces of the dielectric block, and then by forming the first and second slits on the first and second surfaces. That is, the electrode pattern is divided into the first electrode pattern and the second electrode pattern. Herein, the feeding port area of the first electrode pattern is separated from the ground port area of the second electrode pattern by the first slit, and the first electrode pattern is electrically connected to the second electrode pattern via the successive EM coupling by the second slit. Therefore, two electrode patterns serve as radiation elements as well as a power-feeding element and a ground element, respectively.

Compared to the conventional PIFA with the same dimension, the chip antenna of the present invention comprises the electrode with a long resonant length, thereby being resonant at a lower frequency band. Since the EM coupling is successively formed via the second slit of the chip antenna, the resonant frequency of the chip antenna of the present invention extends to a higher frequency band. As a result, the present invention provides a broadband antenna without increasing the size of the chip antenna, and more particularly a super broadband antenna with multi-band characteristics.

As shown in FIGS. 5 to 8, the chip antenna of the present invention has various tuning factors. The antenna characteristics such as the resonant frequency and the bandwidth of the chip antenna of the present invention may be easily adjusted by varying the width of the slit and the length of the electrode pattern, by varying the width of the second electrode pattern, by forming the supplementary slit on the second electrode pattern, or by forming the open area.

As apparent from the above description, in accordance with the present invention, the chip antenna comprises the first and second electrode patterns serving as radiation elements as well as a power-feeding element and a ground element, respectively. The dimension of the electrode patterns is increased by extending the width of the first electrode pattern to correspond to the length of the first slit, and the first and second electrode patterns form the successive resonant length via the second slit. As a result, the chip antenna of the present invention is usable at a broad frequency band in the range from a lower band to a higher band. This broadband chip antenna of the present invention may be realized as a super broadband chip antenna with multi-band characteristics.

The frequency characteristics of the chip antenna of the present invention may be easily adjusted by varying the width of the slit and the length of the electrode pattern, or by variably forming the supplementary slit or the open area.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A chip antenna comprising:

a dielectric block including a first surface, a second surface being opposite to the first surface, and side surfaces being disposed between the first and second surfaces;

a first electrode pattern extending from a feeding port area formed on the first surface to the second surface via one side surface adjacent to the feeding port area; and a second electrode pattern extending from a ground port area formed on the first surface to the second surface via the other side surface adjacent to the ground port area, wherein a first slit is formed as an open area for connecting two opposite sides of the first surface so as to electrically separate the feeding port area of the first electrode pattern from the ground port area of the second electrode pattern, and a second slit is formed in the same direction as the first slit as another open area for connecting two opposite sides of the second surface so as to form an electromagnetic coupling between the first and second electrode patterns.

2. The chip antenna as set forth in claim 1, wherein the first electrode pattern extends so that a length of one side adjacent to the first slit is substantially the same as a length of the other side adjacent to the second slit.

3. The chip antenna as set forth in claim 1, wherein the second electrode pattern extends so that a length of one side adjacent to the first slit is substantially the same as a length of the other side adjacent to the second slit.

4. The chip antenna as set forth in claim 1, wherein an extending length L1 of the first electrode pattern differs from an extending length L2 of the second electrode pattern.

5. The chip antenna as set forth in claim 1, wherein resonant frequency characteristics of the chip antenna are adjusted by varying a width of the second slit.

6. The chip antenna as set forth in claim 1, wherein resonant frequency characteristics of the chip antenna are adjusted by varying an extending length L1 of the first electrode pattern and/or an extending length L2 of the second electrode pattern.

7. The chip antenna as set forth in claim 1, further comprising at least one supplementary slit formed on the first or second electrode pattern in order to separate the first or second electrode pattern into two electrode pattern areas.

8. The chip antenna as set forth in claim 7, wherein one end of the supplementary slit is connected to the first slit and the other end of the supplementary slit is opened along the side surface on which the first or second electrode pattern is formed.

9. The chip antenna as set forth in claim 7, wherein one end of the supplementary slit is connected to the second slit and the other end of the supplementary slit is opened along the side surface on which the first or second electrode pattern is formed.

10. The chip antenna as set forth in claim 7, wherein the supplementary slit is connected to two opposite sides in the same direction of the first slit on the first or second electrode pattern, and the first or second electrode pattern is divided to an electrode pattern area including the feeding port area or the ground port area and another electrode pattern area connected to the second slit by the supplementary slit.

11. The chip antenna as set forth in claim 10, wherein the supplementary slit is formed on the side surface provided with the first or second electrode pattern.

12. The chip antenna as set forth in claim 1, wherein the first or second electrode pattern includes at least one open area on which an electrode is not formed.

13. The chip antenna as set forth in claim 12, wherein at least one of the open areas has its one end disposed within the first or second electrode pattern and its the other end opened to other side surface adjacent to the first or second electrode pattern.

14. The chip antenna as set forth in claim 12, wherein the open area is formed on the first or second surface.

15. The chip antenna as set forth in claim 14, wherein the open area is extended to the side surface adjacent to the first or second surface.

16. The chip antenna as set forth in claim 12, wherein at least one of the open areas is disposed within the first or second electrode pattern.

17. A chip antenna comprising:

a dielectric block including a upper surface, a lower surface, and side surfaces being disposed between the upper and lower surfaces;

an electrode formed on the entire surfaces of the upper and lower surface, and two opposite side surfaces; and slits for connecting opposite sides of two side surfaces without the electrode and dividing the electrode to a first electrode pattern and a second electrode pattern, each of the slits being formed on the upper and lower surfaces of the dielectric block, wherein the slit formed on the lower surface of the dielectric block at least separates a feeding port area from a ground port area, and the other slit formed on the upper surface of the dielectric block connects the first electrode pattern to the second electrode patterns by an EM(Electro-Magnetic) coupling.

* * * * *